US007530524B2

(12) United States Patent
Wieser et al.

(10) Patent No.: US 7,530,524 B2
(45) Date of Patent: May 12, 2009

(54) ARTICULATED NIP IN A DISPENSER APPARATUS

(75) Inventors: Russell G. Wieser, Appleton, WI (US); Jeffrey J. Brickl, Appleton, WI (US)

(73) Assignee: SCA Tissue North America LLC, Neenah, WI (US)

( * ) Notice: Subject to any disclaimer, the term of this patent is extended or adjusted under 35 U.S.C. 154(b) by 395 days.

(21) Appl. No.: 11/390,185

(22) Filed: Mar. 28, 2006

(65) Prior Publication Data

US 2007/0228208 A1 Oct. 4, 2007

(51) Int. Cl.
*B65H 20/02* (2006.01)

(52) U.S. Cl. ..... 242/564.4; 242/580.1; 242/585

(58) Field of Classification Search ..... 242/564, 242/564.1, 564.2, 564.3, 564.4, 565, 579, 242/580, 580.1, 585
See application file for complete search history.

(56) References Cited

U.S. PATENT DOCUMENTS 4,131,044 A 12/1978 Cassia
4,611,768 A * 9/1986 Voss et al. ..... 242/564.2
4,984,530 A 1/1991 Dutton
5,020,403 A * 6/1991 D'Angelo et al. ..... 83/171
5,452,832 A * 9/1995 Niada ..... 225/11
5,979,822 A * 11/1999 Morand et al. ..... 242/564.2
6,237,871 B1 * 5/2001 Morand et al. ..... 242/564.2
6,607,160 B2 * 8/2003 Lewis et al. ..... 242/564.4
6,736,466 B1 5/2004 Helland et al.
6,830,210 B2 12/2004 Formon et al.
6,994,408 B1 2/2006 Bunnell
7,237,744 B2 * 7/2007 Morris et al. ..... 242/560.1
2003/0168550 A1 * 9/2003 Formon et al. ..... 242/564.1

* cited by examiner

*Primary Examiner*—William A Rivera
(74) *Attorney, Agent, or Firm*—Young & Thompson

(57) ABSTRACT

A dispenser has a cover and a housing body. Within the housing body is a pair of rollers having a nip area therebetween. When the cover is open, a disengagement mechanism may be manually depressed to increase the space between one end of the rollers, while the space between an opposing end of the rollers remains substantially unchanged to facilitate the removal of a jam in the nip area of the dispenser.

22 Claims, 6 Drawing Sheets

ARTICULATED NIP IN A DISPENSER APPARATUS

BACKGROUND OF THE INVENTION

1. Field of the Invention

The invention relates to an apparatus for dispensing lengths of absorbent material from a roll or stack of absorbent material such as paper towels, toilet paper or other wiping materials.

2. Description of Related Art

In conventional sheet dispensing apparatus, material from a supply roll or stack of absorbent material is incrementally dispensed through a dispensing opening in a housing. In some dispensers, the sheets may pass between a drive roller and a pinch roller, while still connected to the supply roll and then are dispensed through the dispensing opening. A cutting device may be at the dispensing opening to separate the lengths of material from the supply roll upon dispensing.

A problem with conventional devices is that the material may become jammed in the nip area between the drive roller and the pinch roller. This requires the device to be serviced to remove the jam before the dispenser can properly continue dispensing material.

Several attempts have been made to solve the above-noted problem including a recent attempt shown in U.S. Pat. No. 6,994,408 to Brunnel. The device of Brunnel is complicated in that it requires not only a specialized pinch roller, but a specialized housing as well.

SUMMARY OF THE INVENTION

An object of the invention is to overcome the shortcomings of the prior art, or to alleviate the shortcomings of the prior art at least in part.

Another object of the invention is to have a relative simple device for removing a jam that can preferably be used in existing housings.

BRIEF DESCRIPTION OF THE DRAWINGS

The above and other objects and advantages of the invention will become apparent from the following details description of preferred embodiments thereof, given with reference to the accompanying drawing figures, in which.

DETAILED DESCRIPTION OF THE PREFERRED EMBODIMENTS

Figure 1:
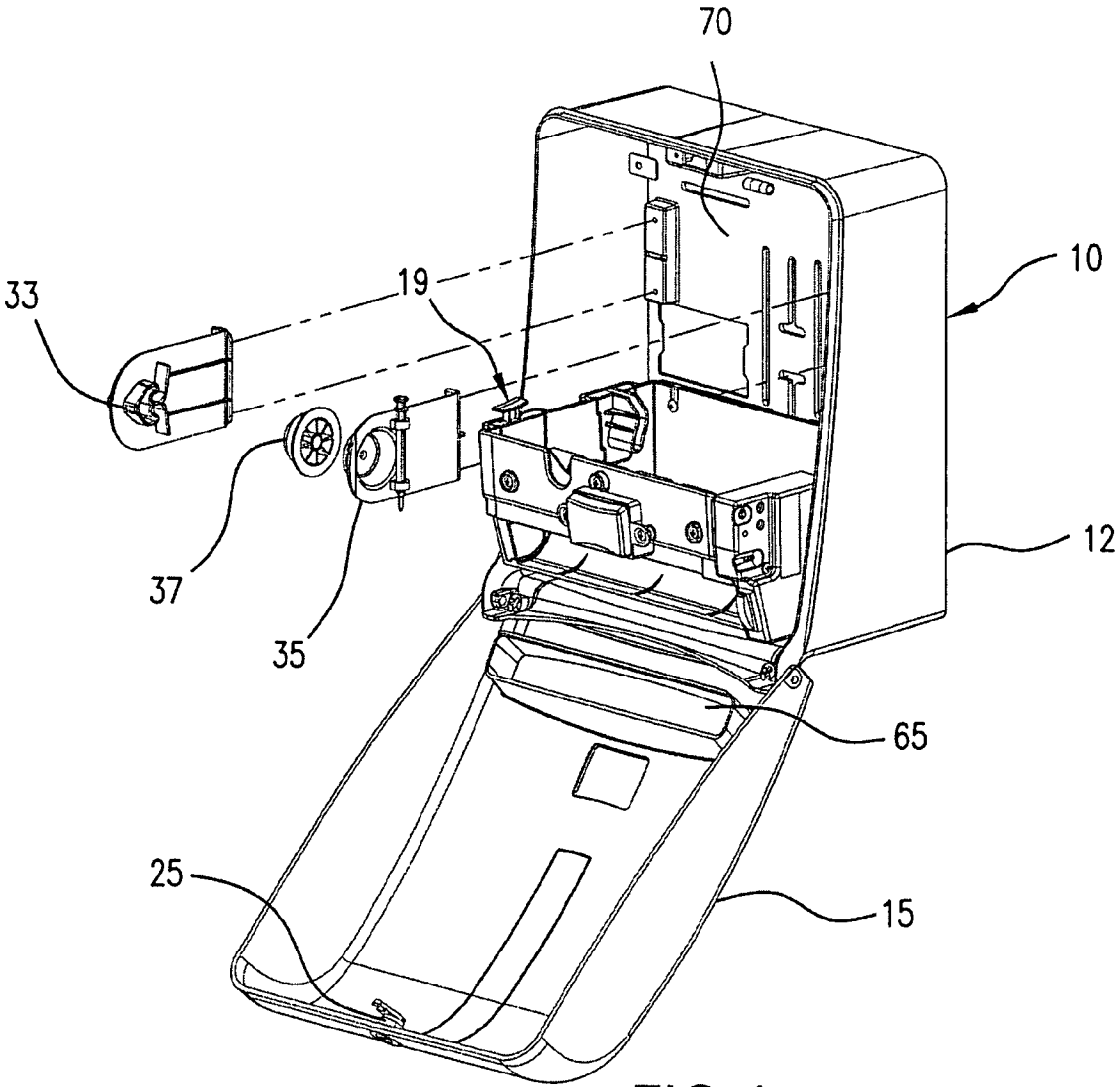
FIG. 1 is a perspective view of a first embodiment of a dispenser according to the invention.

FIG. 1 shows a dispensing apparatus 10 that includes a housing 12 having a front cover 15, which may be articulated to the housing in any manner that allows the front cover 15 to be pivotally mounted to the housing 12. Alternatively, the front cover can be mounted to the housing and be detachable from the housing in an open position. The front cover is retained in a closed position using a lock assembly 25.

Figure 2:
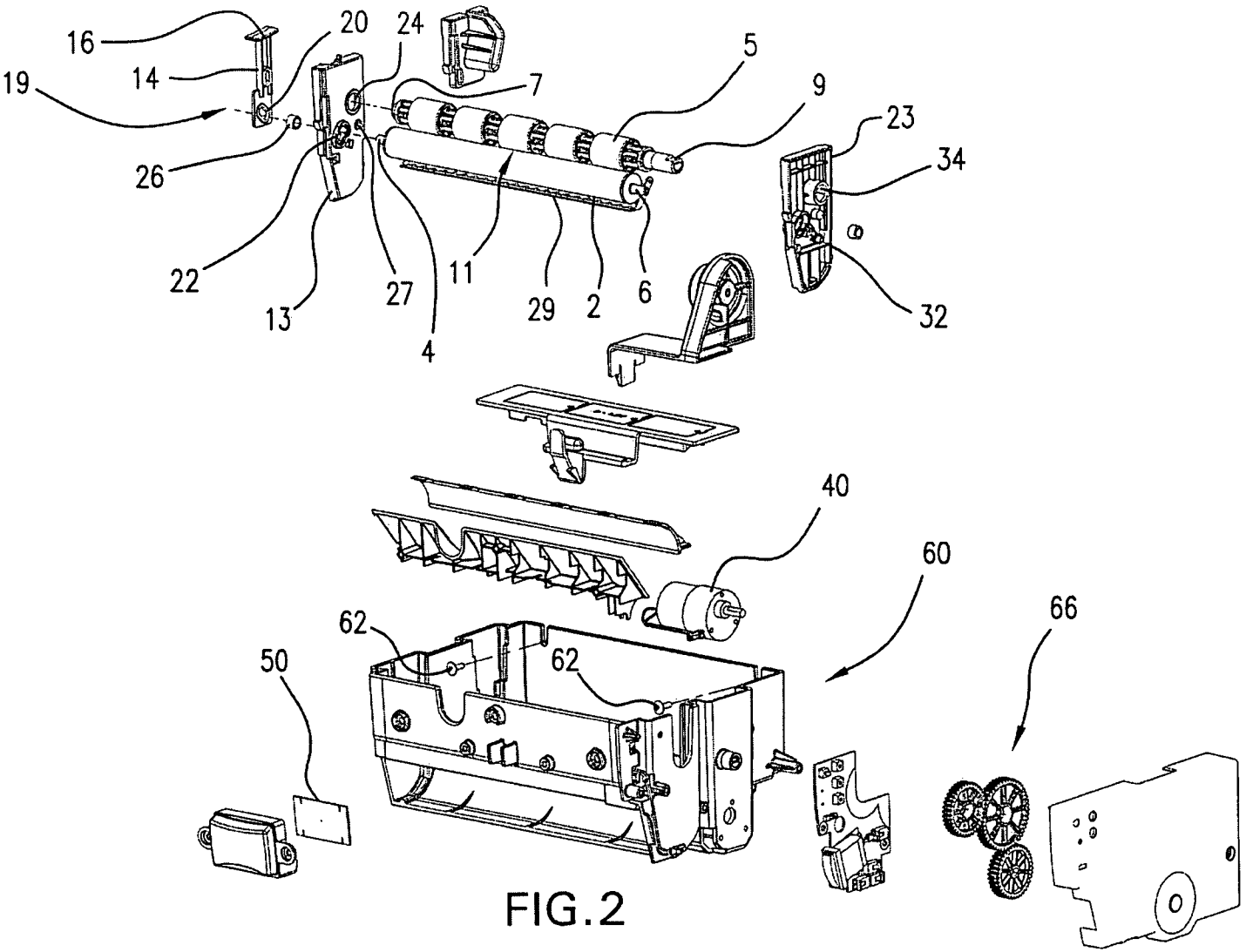
FIG. 2 is an exploded view of material advancing parts and the jam removing parts of the dispenser according to FIG. 1.
Figure 7:
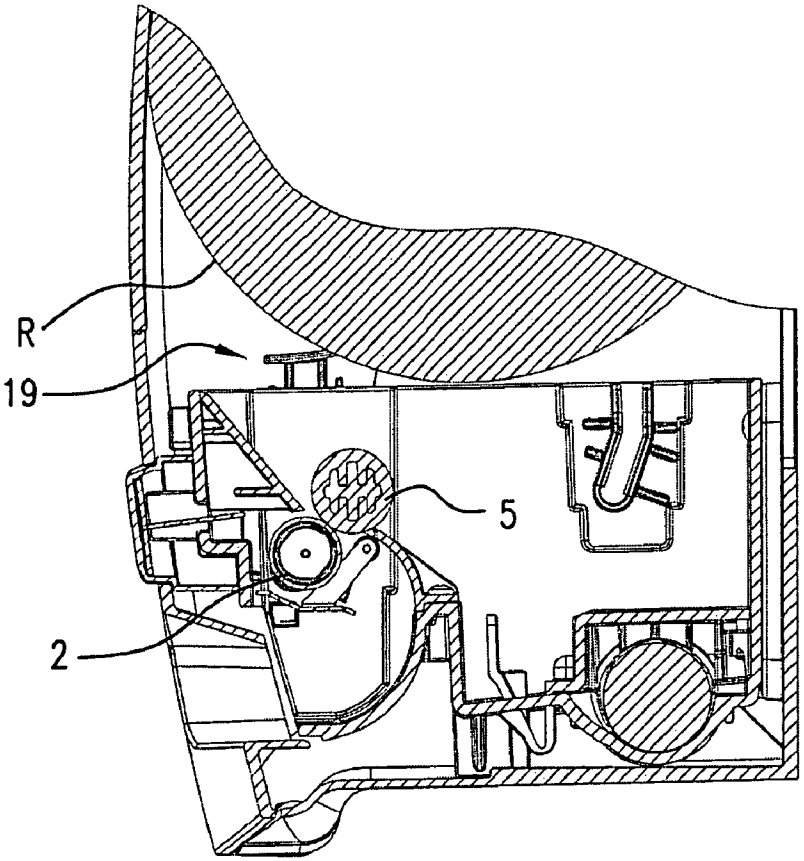
FIG. 7 is a partial sectional view of a dispenser through line 7-7 of FIG. 6 showing the relative position of the pinch roller and drive roller in an operating position.

Within the housing is a roll of absorbent material R (see FIG. 7). As the roll R unrolls, the advancing sheet is fed between pinch roller 2 and drive roller 5. As seen in FIG. 2, the pinch roller 2 is adjacent to a primary roller, which in this embodiment is a drive roller 5 to create a nip area 11. The pinch roller 2 is rotatable with the drive roller 5 to tension absorbent material being unrolled from the roll R when the drive roller 5 is operated.

Figure 4:
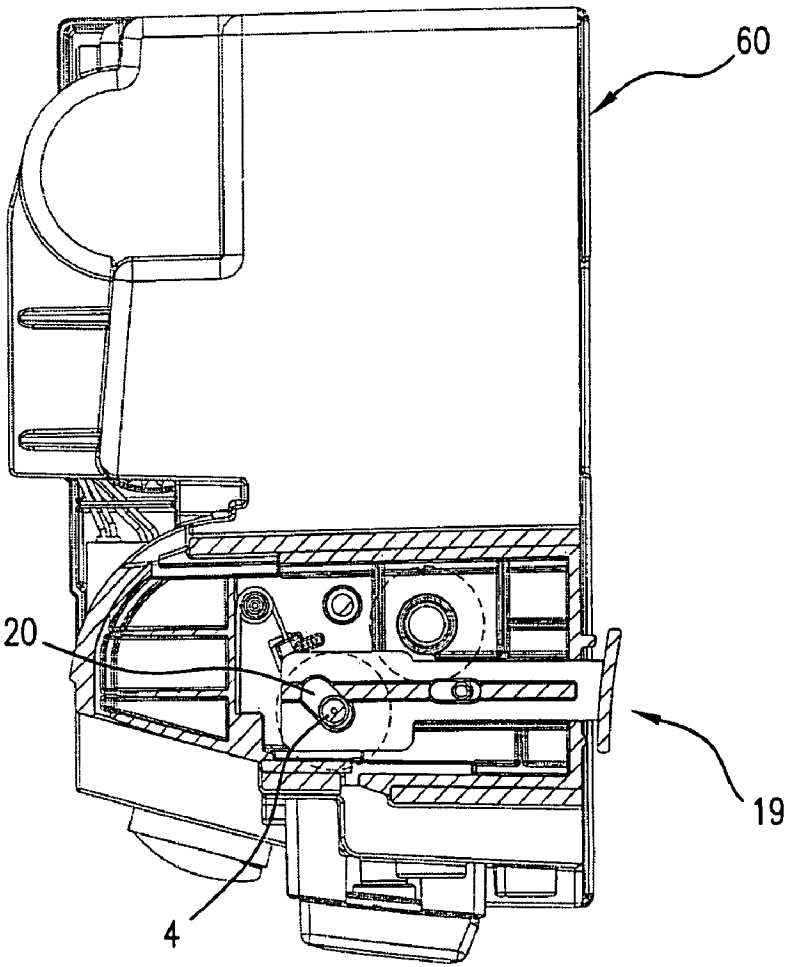
FIG. 4 is a side view showing the first end of the pinch roller of FIG. 3 in a second position.
Figure 3:
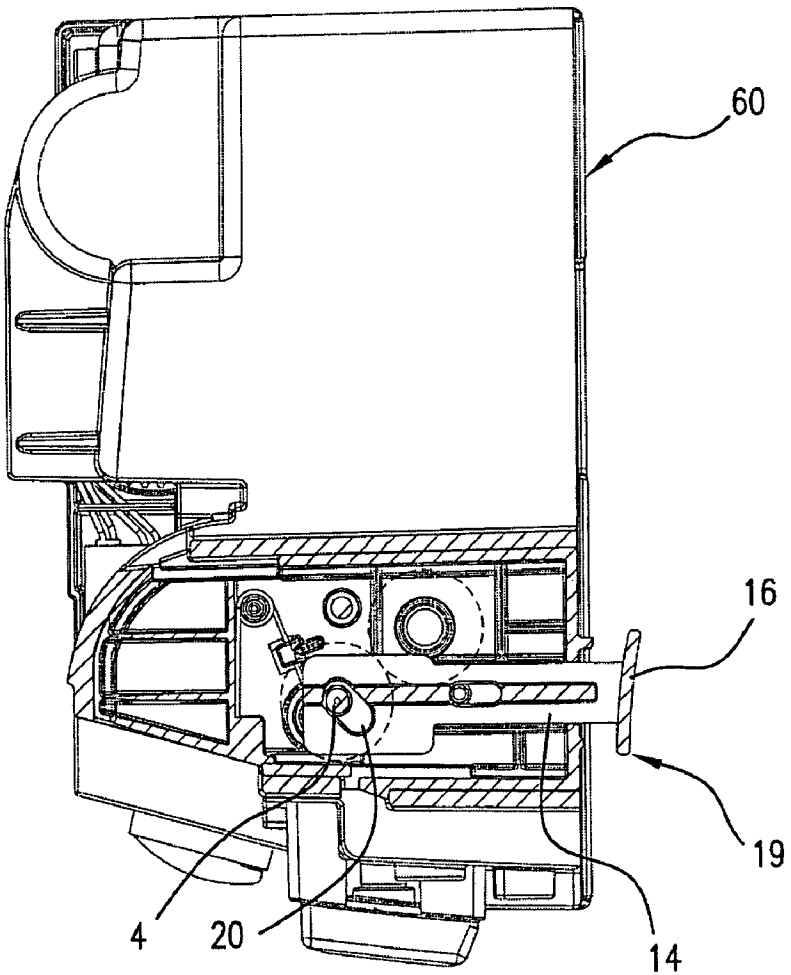
FIG. 3 is a side view of a cassette according to an embodiment of the invention showing a first end of a pinch roller in a first position.
Figure 8:
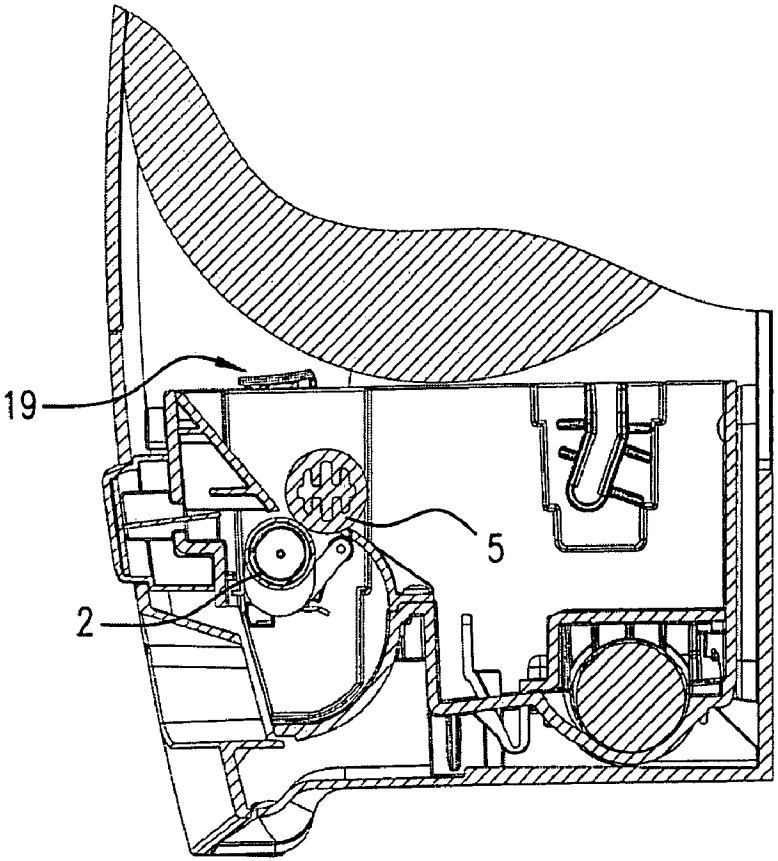
FIG. 8 is a partial sectional view of a dispenser through line 8-8 of FIG. 6 showing the relative position of the pinch roller and drive roller in an jam clearing position.

As further seen in FIG. 2, the pinch roller 2 has a first end 4 and a second end 6. As seen in FIGS. 3 and 4, the first end 4 of the pinch roller 2 is movable from a first position where the pinch roller 2 and the drive roller 5 are contacting or closely adjacent to each other, to a second position where the ends of the pinch and drive rollers 2, 5 are spaced relatively further apart from each other. Whilst the first end 4 of the pinch roller 2 is being moved between the first and second positions, the second end 6 of the pinch roller 2 remains substantially in place, but pivots to keep a distance between the second end 6 of the pinch roller 2 and a second end 9 of the drive roller 5 substantially unchanged as seen in FIGS. 7 and 8. In the first position, the pinch roller 2 may be in contact with the drive roller 5.

In a preferred embodiment, a disengagement mechanism 19 may be a means for pivoting the pinch roller to effectuate movement of the first end 4 of the pinch roller 2 from the first position to the second position. FIG. 2 shows the disengagement mechanism 19 having a shaft 14 and a button 16. A slot 20 that is inclined with respect to a longitudinal axis of the shaft 14 may be near a bottom of shaft 14. The slot 20 receives the first end 4 of the pinch roller 2.

In the embodiment of FIG. 2, the first end 4 of the pinch roller 2 extends through a support plate 13. The support plate has a slot 22 that is inclined in a direction opposite to that of slot 20 so that the disengagement mechanism 19 is able to move in a vertical plane (see FIGS. 3 and 4). Alternatively, it is within the scope of the present invention that the disengagement mechanism 19 moves the first end of the drive roller with respect to the pinch roller.

The support plate 13 may include an opening such as a slot or a circular hole, such as hole 24 that receives the first end 7 of drive roller 5. A second support plate 23, which is similar to the first support plate 13, but does not necessarily include the disengagement mechanism, has additional openings 32, 34 to receive the respective second ends 6, 9 of the pinch roller and the drive roller. The support plate 13 and the second support plate 23 may further include a pin 27 to pivotally receive cutting member 29. Bushings, such as bushing 26 may be on the first end 4 of the pinch roller to provide a bearing surface between the first end 4 and the support plate 13 as well as a spacer between the disengagement mechanism 19 and the support plate 13.

In a presently preferred embodiment, the dispensing apparatus 10 may be a hands-free dispenser that dispenses a length of material upon certain conditions being met, such as the activation of a sensor. Such an embodiment may include a motor 40 and an object detection device 50. The motor 40 drives the drive roller 5 when the motor 40 is triggered to activate, upon the object detection device 50 detecting an object. The object may be a user's hand. However, the type of sensing is not limited in this invention, and could be for example passive or active infrared sensing, or capacitive proximity sensing.

In addition, other embodiments are envisioned such as the "hands-free mechanical" type dispenser or a dispenser that is activated by a mechanical lever or the like.

The roll of absorbent sheet material R to be dispensed from the dispenser may either be a continuous imperforate roll, which is detached from the roll by the user pulling the dispensed sheet against a cutting blade, or may instead be a partially pre-cut web in which the force of the user pulling on the dispensed sheet serves to sever the tabs that connect the dispensed sheet to the next sheet to be dispensed, as is common in hands-free mechanical dispensers. Those pre-cuts can be made either during manufacturing converting of the roll, or in-situ by a blade in the dispenser that pre-cuts the tail of the sheet as it is being dispensed. It is also possible to employ the invention in a dispenser for discrete folded pieces of absorbent sheet material.

Figure 5:
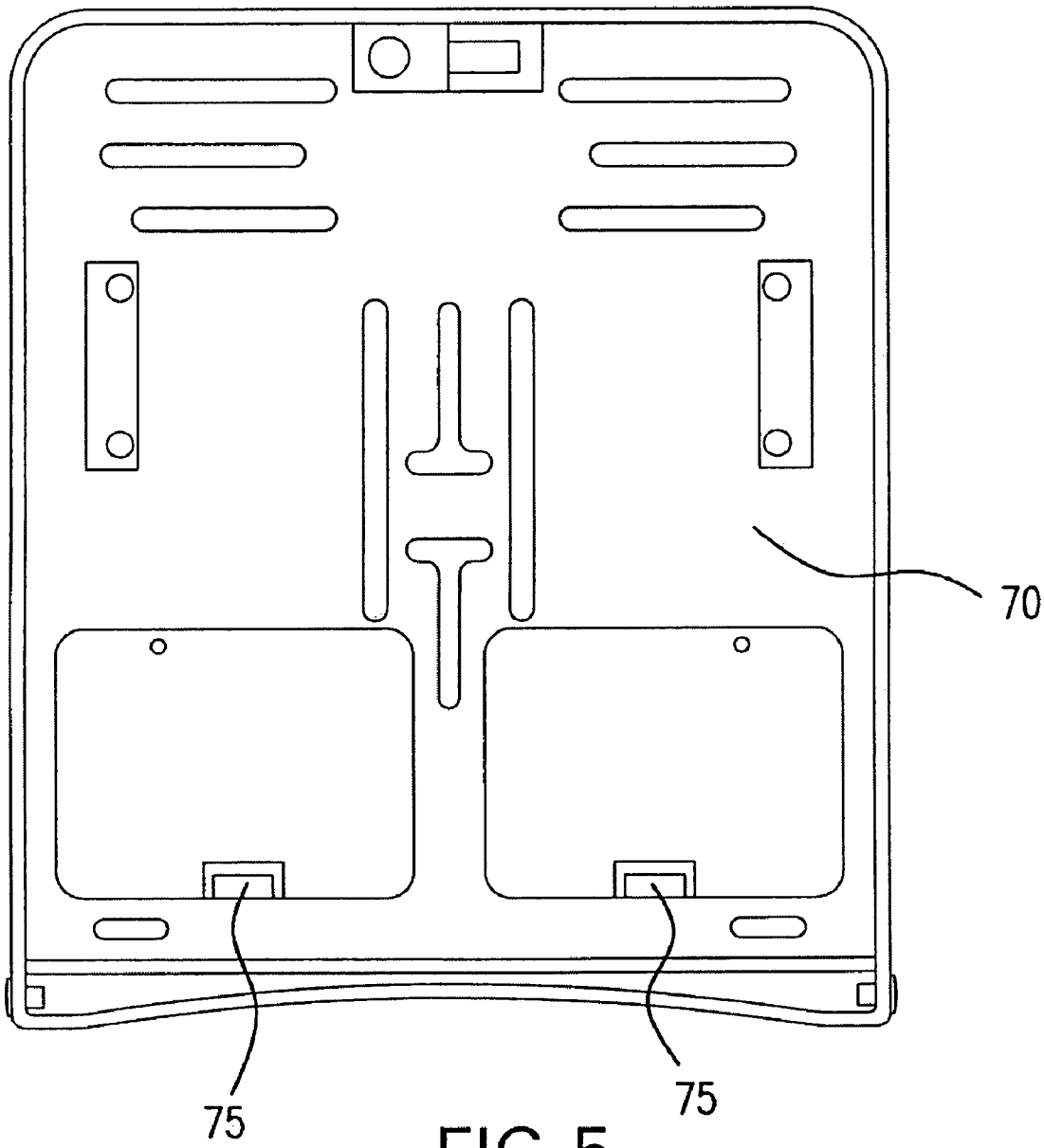
FIG. 5 is a view of the rear mounting wall with a front cover open and a cassette removed from a housing.
Figure 6:
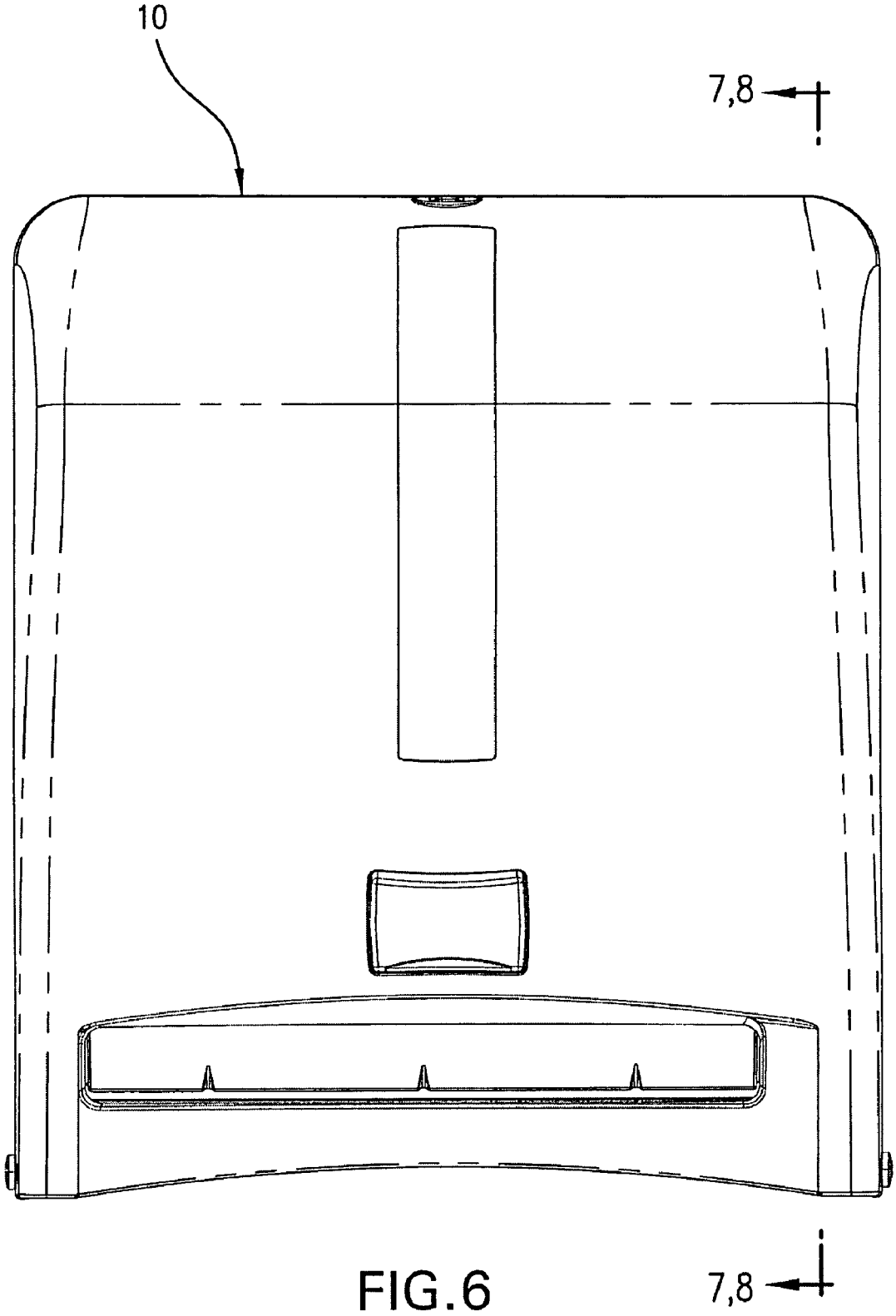
FIG. 6 is a front view with the front cover closed.

In a presently preferred embodiment, the motor 40, the object detection device 50, the drive roller 5, the pinch roller 2, the cutting member 29 and the disengagement mechanism 19 are part of a removable cassette 60. As seen in FIGS. 2 and 5, the cassette 60 may be attached to a rear mounting surface 70 of the housing 12 using one or more screws 62. The rear mounting surface 70 may also include tabs 75 that mate with a notch in the rear of the cassette 60.

Although description is made with respect to a disengagement mechanism being on the side of the cassette 60 opposite the gears 66 of the drive roller 5, it is contemplated that a disengagement mechanism could be on either or both sides of the cassette 60.

Returning to FIG. 1, to support the roll of material R (see FIG. 7), it is contemplated that a roll receiver (not shown) may be inserted into the ends of the roll of material R, which in turn may be supported on roll support arms 33, 35. Alternatively, the receiver may only be at one end of the roll R and supported by the support arm 33, and the other end of the roll may be supported by the roll support arm 35 without a receiver being inserted into the second end of the roll R. In this embodiment, as shown in FIG. 1, for example, the support arm 35 has an extension piece 37 that inserts into the second end of the roll R.

As to the roll or stack of absorbent material, the term absorbent material as used herein embraces not only paper products such as paper towels and napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

In operation, as seen in FIGS. 1 and 7, a web of material is unwound from the roll R and is fed between the pinch roller 2 and the drive roller 5. A feed button (not shown) may be used to energize the drive roller 2 to facilitate the movement of the web into the nip between the pinch roller 2 and the drive roller 5. The web is then fed through an outlet opening 65 in the front cover 15. The front cover 15 is then closed and locked in place using lock assembly 25. The dispensing apparatus is now ready to dispense sheets of absorbent material through the outlet opening 65.

When the sheets are not being dispensed from the dispensing apparatus because of a jam or other malfunction, a maintenance person or other person authorized to unlock the locking assembly 25 may unlock the locking assembly 25 and then rotate the front cover 15 toward him/her. This person would then manually depress the button 16 of the disengagement mechanism 19 to move the pinch roller 2 from the first position to the second position to relieve tension on the web of material. Once the tension on the web of material is relieved, the web of material may be readily dislodged from the nip area 11 to remove the jam.

The invention has been described in detail with respect to presently preferred embodiments. However, it will be apparent to those of skill in the art that changes or modifications may be made without departing from the spirit of the invention. The invention should not be limited by the disclosed embodiments and rather should be defined by the appended claims.

What is claimed is:

1. An apparatus for dispensing lengths of absorbent material from a roll or stack of absorbent material, said apparatus comprising:

a housing;

a primary roller within said housing;

a pinch roller adjacent to said primary roller and rotatable with said primary roller to tension absorbent material being unrolled from a roll or unfolded from a stack of absorbent material when said primary roller is operated, a first end of said pinch roller being movable between a first position adjacent to a first end of said primary roller to a second position further away from said first end of said primary roller, without increasing a distance between a second end of said pinch roller and a second end of said primary roller; and a disengagement mechanism comprising a manually depressible member that moves said pinch roller from said first position to said second position when depressed.

2. The apparatus as claimed in claim 1, further comprising:

a motor within said housing, which drives said primary roller; and an object detection device, which when triggered activates said motor.

3. The apparatus as claimed in claim 2, further comprising a cutting member adjacent to said pinch roller and adjacent to an outlet opening in said housing.

4. The apparatus as claimed in claim 1, wherein said manually depressible member comprises a shaft having an opening, said first end of said pinch roller being received in said opening.

5. The apparatus as claimed in claim 4, wherein said opening is substantially oval and is oriented at an angle with respect to a longitudinal axis of said shaft.

6. The apparatus as claimed in claim 1, further comprising a first support plate having first and second openings, said first end of said primary roller being received in said first opening and said first end of said pinch roller being received in said second opening.

7. The apparatus as claimed in claim 6, further comprising a second support plate having third and fourth openings, a second end of said primary roller being rotatably received in said third opening, said second end of said pinch roller being pivotally received in said fourth opening.

8. The apparatus as claimed in claim 7, wherein said manually depressible member slidably moves within said first support plate to move said pinch roller from said first position to said second position when depressed.

9. The apparatus as claimed in claim 1, wherein said pinch roller and said primary roller substantially press each other to form a nip area, such that said second end of said pinch roller and said second end of said primary roller still substantially press each other when said first end of said primary roller is at said second position.

10. An apparatus for dispensing lengths of absorbent material from a roll of absorbent material, said apparatus comprising:

a housing;

a roll receiver adapted to hold a roll of absorbent material;

a cassette removably mounted in said housing, said cassette comprising: a motor;

an object sensor, which when triggered activates said motor; a drive roller driven in rotation by said motor;

a pinch roller adjacent to said drive roller; and a release member having a first opening, a first end of one of said pinch roller and said drive roller being received in said first opening, said first end of said one of said pinch roller and said drive roller being movable away from said first end of the other of said drive roller and said pinch roller when said release member is manually depressed.

11. The apparatus as claimed in claim 10, wherein the cassette further comprises a first support member having second and third openings, said first end of said drive roller being in said second opening and said first end of said pinch roller extending through said third opening into said first opening.

12. The apparatus as claimed in claim 11, further comprising a second support member having fourth and fifth openings, said second end of said drive roller being received in said fourth opening and said second end of said pinch roller being pivotally received in said fifth opening.

13. The apparatus as claimed in claim 12, further comprising a cutting member connected to said first and second support members and being adjacent to an outlet opening of said housing.

14. The apparatus as claimed in claim 10, further comprising a support member, said second end of said pinch roller being pivotally received by said support member.

15. The apparatus as claimed in claim 10, wherein said pinch roller and said primary roller substantially press each other to form a nip area, such that a second end of said pinch roller and a second end of said drive roller still substantially press each other when said release member is manually depressed.

16. An apparatus for dispensing lengths of absorbent material from a roll of absorbent material, said apparatus comprising:

a housing;

a drive roller within said housing;

a pinch roller adjacent to said drive roller and rotatable therewith; and means for pivoting said pinch roller from a first position adjacent to said drive roller to a second position spaced further apart from said drive roller.

17. The apparatus as claimed in claim 16, further comprising a cutting member adjacent to an outlet opening of said housing.

18. The apparatus as claimed in claim 16, further comprising a motor that drives said drive roller.

19. The apparatus as claimed in claim 18, further comprising an object sensor that activates said motor when said object sensor is triggered.

20. The apparatus as claimed in claim 19, wherein said housing comprises a main body and a cover rotatably connected to said main body, each of said drive roller, said pinch roller, said means for pivoting said pinch roller, said motor and said sensor being part of a cassette that is removable from said main body, when said cover is in an open position.

21. The apparatus as claimed in claim 16, wherein said pinch roller is in contact with said drive roller in said first position.

22. The apparatus as claimed in claim 16, wherein said pinch roller and said primary roller substantially press each other to form a nip area, such that an end of said pinch roller still substantially contacts an end of said drive roller when said pinch roller is at said second position.

* * * * *